US008528903B2

(12) United States Patent
Katz

(10) Patent No.: US 8,528,903 B2
(45) Date of Patent: Sep. 10, 2013

(54) METHOD AND DEVICE FOR DETERMINING THE SECONDARY ATTRIBUTES OF A SYMBOL BY CHANCE

(76) Inventor: Daniel Katz, New York, NY (US)

( * ) Notice: Subject to any disclaimer, the term of this patent is extended or adjusted under 35 U.S.C. 154(b) by 111 days.

(21) Appl. No.: 13/098,595

(22) Filed: May 2, 2011

(65) Prior Publication Data

US 2012/0280448 A1 Nov. 8, 2012

(51) Int. Cl.
*A63F 1/00* (2006.01)

(52) U.S. Cl.
USPC ..... 273/138.2

(58) Field of Classification Search
USPC ..... 273/138.2
See application file for complete search history.

(56) References Cited

U.S. PATENT DOCUMENTS

| | | | | |
|---|---|---|---|---|
| 3,598,414 | A | 8/1971 | Dhiegh | |
| 3,633,916 | A | 1/1972 | Thomas | |
| 4,462,596 | A * | 7/1984 | Yamamoto | 273/239 |
| 4,953,864 | A * | 9/1990 | Katz | 273/161 |
| 4,991,836 | A | 2/1991 | Joffe | |
| 5,037,106 | A * | 8/1991 | Jodway | 273/239 |
| 5,421,581 | A * | 6/1995 | Smith | 273/239 |
| 5,636,840 | A * | 6/1997 | Gardner et al. | 273/161 |
| 5,651,682 | A | 7/1997 | Blok | |
| 6,431,936 | B1 * | 8/2002 | Kiribuchi | 446/92 |
| 6,441,514 | B1 | 8/2002 | Markle | |
| 7,154,363 | B2 * | 12/2006 | Hunts | 335/306 |
| 7,273,404 | B2 * | 9/2007 | Kowalski et al. | 446/92 |
| 7,322,873 | B2 * | 1/2008 | Rosen et al. | 446/91 |
| 7,412,493 | B2 * | 8/2008 | Duigenan et al. | 709/217 |
| 7,785,239 | B2 * | 8/2010 | Daniel | 482/108 |
| 7,955,156 | B2 * | 6/2011 | Toht et al. | 446/92 |
| 2011/0223566 | A1 * | 9/2011 | Shen et al. | 434/128 |

FOREIGN PATENT DOCUMENTS

| | | |
|---|---|---|
| WO | WO 01/55996 | 2/1991 |

* cited by examiner

*Primary Examiner* — Kurt Fernstrom
*Assistant Examiner* — Dolores Collins
(74) *Attorney, Agent, or Firm* — Ladas & Parry LLP

(57) ABSTRACT

A method and device for determining the secondary attributes of a symbol by chance comprising a holder having a partition, relatively short magnets, and an elongated magnet. The relatively short magnets have a smaller length than the elongated magnet. The I-Ching is consulted by placing two relatively short magnets in a random position on a first compartment of the holder and the elongated magnet is retained on a retaining surface in the second compartment of the holder. The sides of each of the relatively short magnets adjacent the elongated magnet and the sides of each of the relatively short magnets adjacent each other form three pairs of interacting magnetic poles. The user assigns a predetermined state to each of the eight magnetic interactions, records the state represented by the magnetic interaction, and repeats these steps until one or more I-Ching hexagrams are constructed.

11 Claims, 5 Drawing Sheets

METHOD AND DEVICE FOR DETERMINING THE SECONDARY ATTRIBUTES OF A SYMBOL BY CHANCE

FIELD OF THE INVENTION

The present invention relates in general to an apparatus and method for obtaining chance-controlled images or patterns for generating personalized chance-controlled images or patterns which may be correlated to a communications code or to the structural aspects of a language, for example words, phonemes or the alphabet, or which enable interrogation of a forecasting medium such as the I-Ching, an ancient and venerable Chinese guide to insight and decision making.

BACKGROUND OF THE INVENTION

A significant advance in the design of chance-controlled mechanisms is reflected in U.S. Pat. No. 4,953,864 to Katz (the "Katz '864 patent"). The Katz '864 patent teaches an apparatus and method involving selecting at random relatively indistinguishable bar magnets or other magnetized objects and bringing them into the proximity of each other to allow the magnets to exhibit attraction or repulsion. When the device is used for consultation of the I-Ching, the chance occurrence of the magnetic interaction between the bar magnets is used to select a predetermined visually apparent representation of either a broken or solid line to enable the user to determine the state of a line and to obtain a sufficient number of such lines to complete an I-Ching hexagram. The Katz '864 patent also teaches using a holder frame to retain the magnets in appropriate alignment so that the magnets in proximity to each other are retained in alignment to represent a solid or broken line.

The Katz '864 patent also teaches determining a "weak" or "changing" state by the magnetic interaction between a pair of magnets through usage of a marking on a face of the magnets with the presence or absence of the marked face in the resulting line indicating whether the line is "weak" or "changing". However a disadvantage of this configuration is that since the marking is visible, the magnets are not indistinguishable and the user is able to consciously or unconsciously choose a particular magnet or position of a magnet when making their selection.

The Katz '864 patent also discloses providing a chance controlled mechanism for generating a visually apparent representation of a "weak" or "changing" line by placing three relatively indistinguishable magnets aligned end to end within a single longitudinal groove of a holder. The user then observes the magnetic interaction between the two adjacent pairs of magnetic poles. The four total possible reactions for the two pairs of interacting poles allows the user to assign "solid" or "broken" lines as well as assign "weak" or "changing" states to the four magnetic interactions. A disadvantage with this device is that the probabilities created by this device are not reflective of the traditional chances for obtaining a representation of a "weak" or "changing" state for a line in an I-Ching hexagram.

The present invention concerns an improvement of the invention taught by the Katz '864 patent which provides for an apparatus and method for chance controlled formation of a symbol through the use of magnetic interactions between magnets wherein separate poles of a magnet simultaneously react with poles on other magnets to provide an increased number of possible magnetic interactions for improved consultation of the I-Ching. The presence of three pairs of interacting magnetic poles provides a probability of ⅛ for a "changing" broken line or ⅛ for a "changing" solid line which is reflective of the traditional probability for obtaining such representations. Furthermore, the magnets need no markings and the relatively short magnets will be virtually indistinguishable from each other to avoid conscious or unconscious "cheating" when choosing magnets.

Accordingly, it is an object of the present invention to provide a method and apparatus for chance controlled formation of a symbol that utilizes at least one magnetic body which reacts with poles on a plurality of other magnets to provide an increased number of magnetic interactions and allow the determination of whether a line is "solid" or broken" and whether it has a "changing" state and having a probability for such a changing state reflective of the traditional probability therefor;

Yet another object of the present invention is to provide an apparatus for improved chance controlled formation of a symbol through the use of magnetic interactions which determine whether a line is "solid" or "broken" and whether it has a "changing" state through the use of relatively indistinguishable magnets and having a probability for such a changing state reflective of a traditional probability therefor;

It is another object of the present invention to provide an apparatus for improved chance controlled formation of a symbol through the use of magnetic interactions between magnets that is portable and economical to manufacture.

SUMMARY OF THE INVENTION

The present invention is directed to a method and device for determining the secondary attributes of a symbol by chance incorporating many of the significant features of the before mentioned Katz '864 patent, while providing an apparatus and method allowing for an increased number of possible magnetic interactions. The present invention features at least one magnet whereby separate poles of the magnet react with poles on other magnets to provide an increased number of possible magnetic interactions for improved consultation of the I-Ching.

The apparatus comprises a holder, two relatively short magnets, and an elongated magnet. The holder has a partition separating the holder into first and second compartments. The partition retains the magnets within the compartments.

The relatively short magnets are indistinguishable in appearance and in terms of polarity from each other and each relatively short magnet has a smaller length than the elongated magnet. The user utilizes the apparatus to determine the attributes of an I-Ching symbol for consultation of the I-Ching by placing two relatively short magnets in a random position in the first compartment of the holder. The elongated magnet in the second compartment of the holder is held in the second compartment by a retaining surface. The sides of each of the relatively short magnets adjacent the elongated magnet, the side of the elongated magnet adjacent the relatively short magnets, and the sides of each of the relatively short magnets adjacent each other form three pairs of interacting magnetic poles which exhibit a repulsion or attraction to each other. The movement of the relatively short magnets and the elongated magnet based on the magnetic interactions between the three pairs of adjacent magnetic poles will display one of eight possible different interactions. In accordance with the method of the present invention, the user assigns a predetermined state to each of the eight magnetic interactions, records the state represented by the magnetic interaction, and repeats these steps until one or more I-Ching hexagrams are constructed.

DESCRIPTION OF THE DRAWINGS

The foregoing and other objects, features and advantages of the present invention will become apparent from the following description of a preferred embodiment of the invention, taken in conjunction with the accompanying drawings, wherein.

DETAILED DESCRIPTION OF THE PREFERRED EMBODIMENTS

Figure 1:
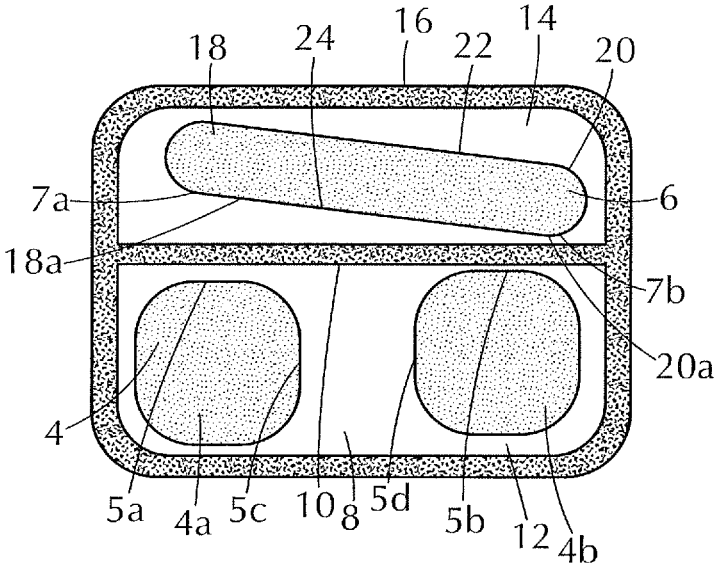
FIGS. 1-8 are top plan views of the apparatus of the present invention having no retaining surface in the second compartment of the holder showing the eight possible magnetic interactions representing lines of an I-Ching symbol.
Figure 2:
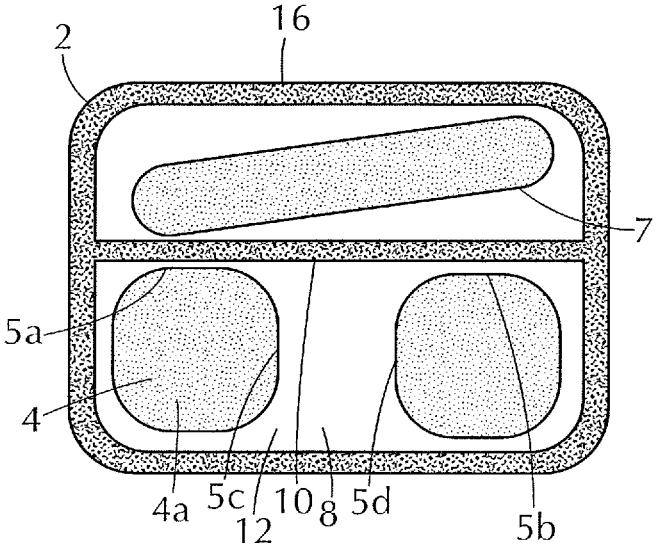
Figure 3:
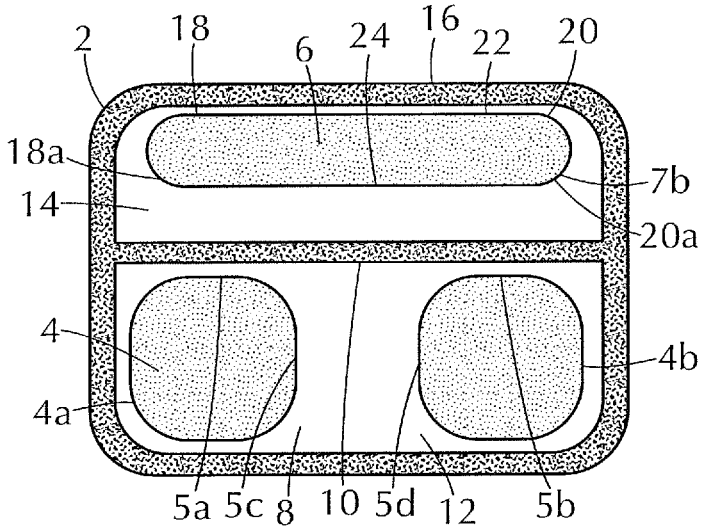
Figure 4:
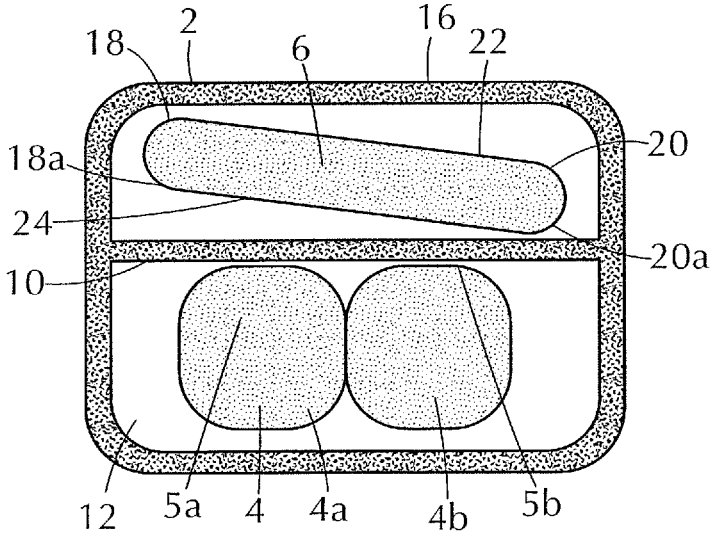
Figure 5:
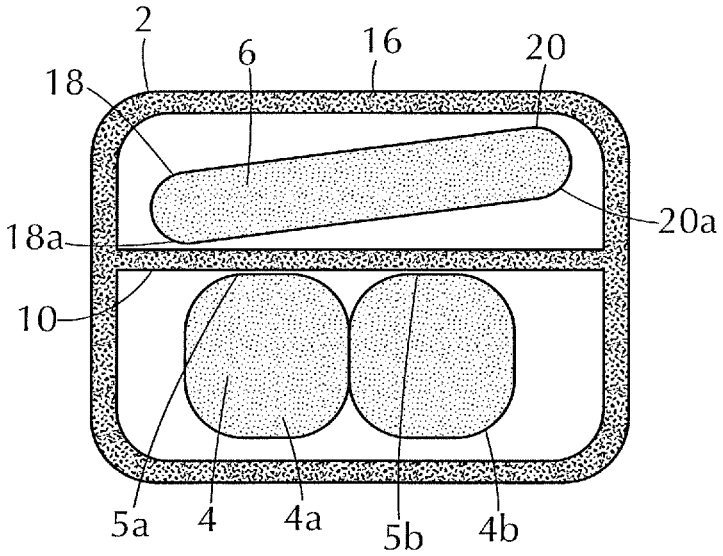
Figure 6:
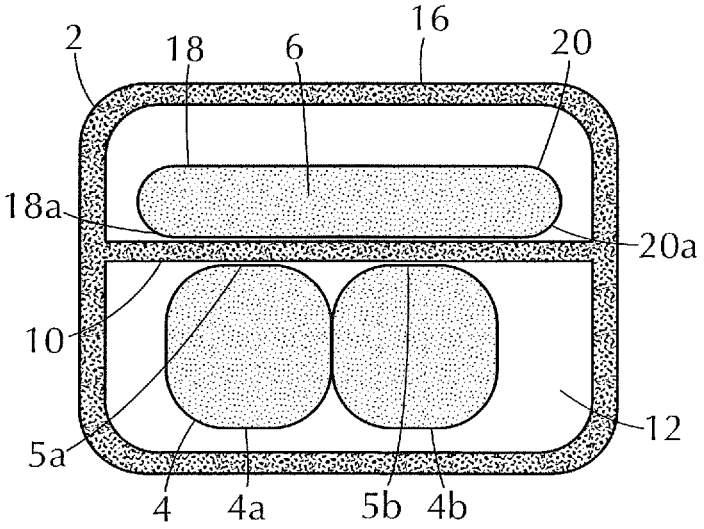

With reference to FIGS. 1-8, the present invention is directed to a method and device for determining the secondary attributes of a symbol by chance. The apparatus of the invention comprises a shallow tray or holder 2, two relatively short magnets 4, and an elongated magnet 6. The term "magnet" as used herein refers to an object fabricated mainly out of a material that produces a magnetic field such as a ferromagnetic material. The term "magnet" may also refer to an object having a significant portion of its body comprised of a non-magnetic material, such as wood, which contains a plurality of magnetic materials on its periphery in order to function similar to an object comprised mainly out of a magnetic material.

The holder 2 is fabricated out of a non-magnetic material and includes a flat base or supporting surface 8 for the magnets. The holder 2 has a partition wall 10 dividing the holder into first and second compartments 12, 14. As shown in FIGS. 1-8, the partition wall 10 may be offset to one side so that one compartment is larger than the other or may be placed along the centerline to form identically-sized compartments. A peripheral wall 16 circumscribes the base of the holder 2.

As shown in FIGS. 1-8, the relatively short magnets 4 comprise first and second magnets 4*a*, 4*b*, respectively, which are indistinguishable from each other in terms of appearance and polarity. The relatively short magnets 4 may be formed in a variety of shapes well known in the art. In the embodiment shown in FIGS. 1-8, the relatively short magnets are generally square-shaped with rounded corners.

The new and improved apparatus also includes an elongated magnet 6 having two elongated edges 22, 24 with first and second ends 18, 18*a*, 20, 20*a*, respectively. One elongated edge of the elongated magnet 6 has a positive polarity and the opposing elongated edge of the elongated magnet 6 has a negative polarity. The magnetic polarities of each respective elongated edge are the same at the first and second ends of that edge. The elongated magnet 6 is longer than each of the relatively short magnets 4 which allows the elongated magnet to lie adjacent to both first magnet 4*a* and second magnet 4*b* of the relatively short magnets. The elongated edge of the elongated magnet 6 adjacent the relatively short magnets 4 exhibits separate magnetic attraction or repulsion with each of the relatively short magnets 4. The relatively short magnets 4 and the elongated magnet 6 provide three pairs of adjacent, interacting magnetic poles. While the elongated magnet 6 is shown as a single, unitary elongated magnet, in other embodiments, the elongated magnet may comprise a plurality of magnetic bodies with magnetic poles that interact with each other.

Figure 8:
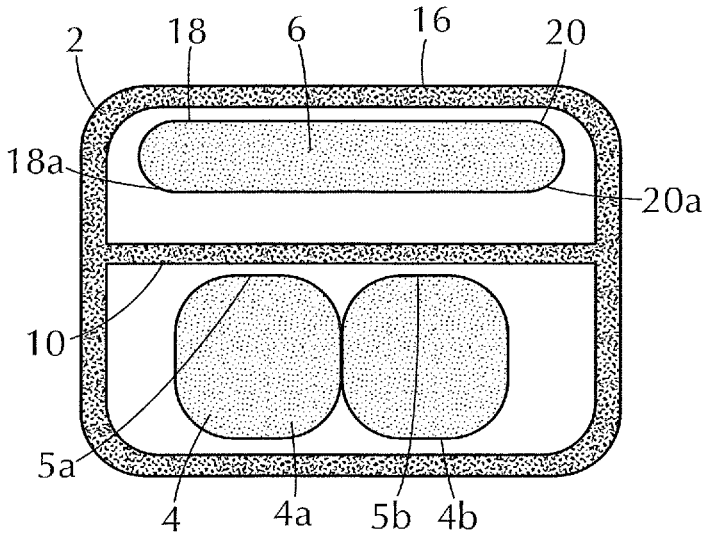
Figure 9:
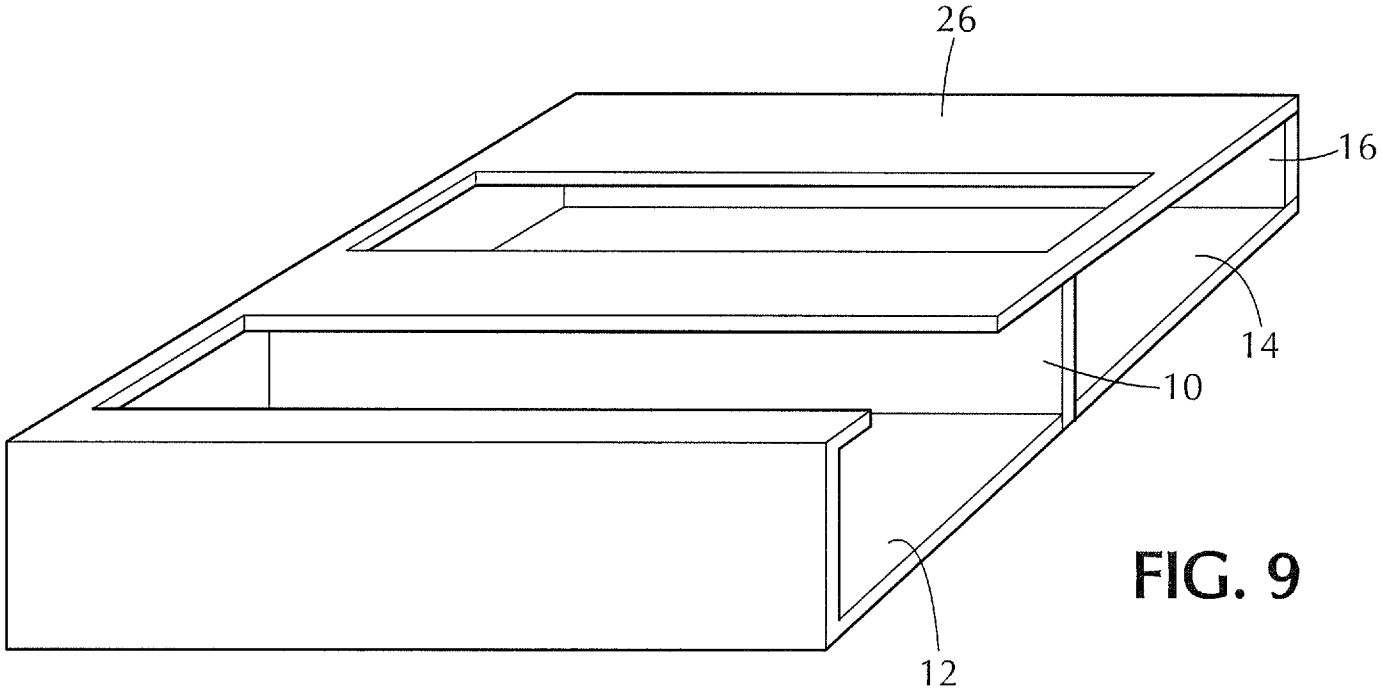
FIG. 9 is a perspective view of the holder having a retaining surface in the second compartment.

As shown in FIG. 9, the second compartment 14 of the holder has a retaining surface 26 which prevents the user from accessing the elongated magnet. The retaining surface shown in FIG. 9 comprises a planar wall 28 extending horizontally along the topmost portion of the holder. The elongated magnet 6 is placed within the second compartment either during the manufacturing process or by the user prior to use of the device and method. Movement of the elongated magnet 6 within the second compartment 14 is limited by the partition wall 10 and the peripheral wall 16 so that the elongated magnet cannot rotate more than 89 degrees and the elongated edge adjacent to the relatively short magnets 4 remains the same in order to serve as a constant unknown magnetic field on the relatively short magnets 4. In an alternative embodiment shown in FIGS. 1-8, the holder has no retaining surface on the second compartment of the holder.

In accordance with the method of the present invention, the user utilizes the invention to determine the attributes of a symbol for consultation of the I-Ching. The method comprises a first step of selecting two magnets from the relatively short magnets 4 and randomly positioning them on the first compartment 12 of the holder 2. In the preferred embodiment, the elongated magnet 6 is already positioned in the retaining surface 26 on the second compartment 14 of the holder. The sides 5*a*, 5*b* of each of the relatively short magnets 4 which face the partition 10 and the adjacent side 7 of the elongated magnet which faces the partition will exhibit a repulsion and/or attraction to each other. Further, the side 5*c*, 5*d* of the first magnet 4*a* and second magnet 4*b* of the relatively short magnets are adjacent to each other and exhibit a repulsion or attraction to each other.

In the alternative embodiment shown in FIGS. 1-8, the holder has no retaining surface on the second compartment of the holder. In this embodiment, the method requires an additional step of having the user select the elongated magnet 6 and randomly position the elongated magnet on the second compartment 14 of the holder 2 in a manner so that an elongated edge is in a generally parallel orientation with respect to the partition.

As shown in FIGS. 1-8, when the relatively short magnets 4 are randomly placed in the holder 2, depending on the polarity of side 5*a* of the first magnet of the relatively short magnets 4 which faces the partition 10 and the polarity of the surface 7*a* facing the partition on the first end 18*a* of the adjacent elongated edge of the elongated magnet, the first magnet 4*a* of the relatively short magnets will be attracted to or repelled by the first end 18*a* of the adjacent elongated edge of the elongated magnet and will move in a direction toward or away from the partition 10 and the first end 18*a* of the adjacent elongated edge of the elongated magnet will be moved away from or toward the first magnet 4*a* in a direction toward or away from the partition wall 10.

Depending on the polarity of the side 5*b* of the second magnet of the relatively short magnets 4 which faces the partition 10 and is adjacent to the second end 20*a* of the adjacent elongated edge of the elongated magnet and the polarity of the surface 7*b* on the second end 20*a* of the adjacent elongated edge of the elongated magnet, the second magnet 4*b* of the relatively short magnets will move toward or away from the partition 10 and the second end of the elongated edge of the elongated magnet will also move toward or away from the second magnet 4*b* in a direction toward or away from the partition wall 10. The first and second magnets 4*a*, 4*b* of the relatively short magnets will also move away from each other or towards each other within the first compartment 12 of the holder depending on the polarity of the poles on sides 5*c*, 5*d*. If the magnetic polarities of sides 5*c* and 5*d* are opposite each other, the first and second magnets 4*a*, 4*b* will be attracted to each other and will touch due to the magnetic attraction. If the polarities on the sides 5*c* and 5*d* are the same, the first and second magnets 4*a*, 4*b* will be repelled toward the peripheral wall 16.

Traditionally, an I-Ching hexagram is constructed line by line, beginning with the bottom line. Each hexagram is constructed of six lines. The basic states assigned to each line are broken or unbroken. To use the present invention to determine the lines of each hexagram and the resulting hexagram, the user assigns a predetermined state to each type of magnetic interaction exhibited by the device. The user then randomly places the relatively short magnets 4 on the holder having the elongated magnet 6 retained therein, records the state represented by the magnetic interaction between the two relatively short magnets 4 and between the relatively short magnets 4 and the elongated magnet 6, and repeats these steps until one or more hexagrams are constructed. There are sixty-four distinct hexagrams within the I-Ching which are the subject of a coded oracular pronouncement and commentary within the I-Ching.

The present invention allows the user to make use of a more advanced concept associated with consultation of the I-Ching, known as "weak" or "changing" lines of the hexagram. Such "moving" lines have additional significance and subtlety in consulting the I-Ching, enabling the consultant to obtain more comprehensive information from the I-Ching text.

Figure 7:
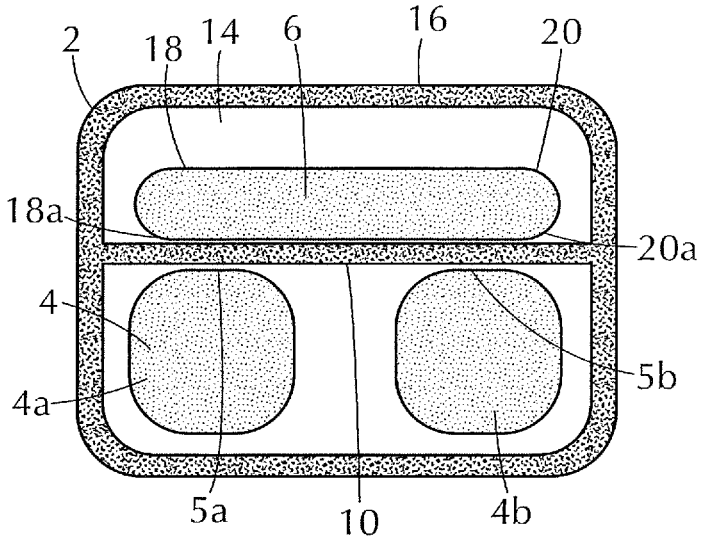

For example, where only two magnets are used for each line, then only two possible states exist—a "strong" solid line or a "strong" broken line. However, the present invention having three different pairs of interacting magnetic poles allows for eight different magnetic interactions. Therefore, the user who prefers the added subtlety of "moving" lines can assign one or more magnetic interactions to a "changing" state. The probabilities of obtaining a "changing" broken line or a "changing" solid line in accordance with this invention are each ⅛ which are reflective of traditional probabilities for the development of lines for an I-Ching hexagram. For instance, the magnetic interaction shown in FIG. 7 shows the elongated magnet 6 attracted to both first 4*a* and second 4*b* magnet of the relatively short magnets and the first and second magnets being repelled from each other. This interaction may be assigned the state of a changing broken line. The magnetic interaction shown in FIG. 8 shows the first and second magnets 4*a*, 4*b* of the relatively short magnets attracted to each other and the elongated magnet 6 repelled from the relatively short magnets. This state may be assigned as a changing solid line. The magnetic interactions shown in FIGS. 1-3 may be assigned the state of a broken line. The magnetic interactions in FIGS. 4-6 may be assigned the state of a solid line. The predetermined states of the lines based on the magnetic interactions under this method allows a 1 in 4 chance of a "weak" or "changing" state which is desirable for subtle, advanced consulting of the I-Ching.

It should be understood of course that the specific embodiment of the invention herein illustrated and described is intended to be representative only, as certain variations may be made therein without departing from the clear teachings of the disclosure. Accordingly, reference should be made to the following appended claims in determining the full scope of the invention.

I claim:

1. A method for determining by chance the state for each of a plurality of lines having more than one possible state said plurality of lines together forming an I-Ching symbol comprising the steps of:

(a) juxtaposing a set of a plurality of magnets with each other and with a second magnet in such proximity as will induce magnetic interaction between said set of a plurality of magnets with each other and between each magnet of said set of a plurality of magnets and said second magnet wherein at least three adjacent pairs of magnetic poles interact with each other and each magnet interacts with at least two other magnets;

(b) assigning to said magnetic interactions a predetermined one of the possible states for a line which forms a portion of an I-Ching symbol;

(c) obtaining a visual representation of a line in accordance with said assigned state; and (d) repeating steps (a)-(c) until the state of each line is visually apparent wherein the plurality of lines together form an I-Ching symbol.

2. The method of claim 1, in which said set of a plurality of magnets comprises two relatively short magnets and said second magnet comprises an elongated magnet having a plurality of elongated edges having first and second ends, said elongated magnet being longer than each of said relatively short magnets thereby allowing said elongated magnet to lie in substantially adjacent relationship to each of said set of a plurality of magnets for inducing magnetic interaction therebetween.

3. The method of claim 2, comprising:

(i) Assigning the state of a broken line to:

magnetic repulsion of said first magnet of said set of a plurality of magnets with said first end of an elongated edge of said elongated magnet and of said first and second magnets of said set of a plurality of magnets and magnet attraction of said second magnet of said set of a plurality of magnets with said second end of an elongated edge of said elongated magnet;

magnetic repulsion of said second magnet of said set of a plurality of magnets with said second end of an elongated edge of said elongated magnet and of said first and second magnets of said set of a plurality of magnets and magnet attraction of said first magnet of said set of a plurality of magnets with said first end of an elongated edge of said elongated magnet;

magnetic repulsion of said first magnet of said set of a plurality of magnets with said first end of an elongated edge of said elongated magnet, of said first and second magnets of said set of a plurality of magnets, and of said second magnet of said set of a plurality of magnets with said second end of an elongated edge of said elongated magnet;

(ii) Assigning the state of a solid line to:

magnetic repulsion of said first magnet of said set of a plurality of magnets with said first end of an elongated edge of said elongated magnet and magnet attraction of said second magnet of said set of a plurality of magnets with said second end of an elongated edge of said elongated magnet and of said first and second magnets of said set of a plurality of magnets;

magnetic repulsion of said second magnet of said set of a plurality of magnets with said second end of an elongated edge of said elongated magnet and magnet attraction of said second magnet of said set of a plurality of magnets with said second end of an elongated edge of said elongated magnet and of said first and second magnets of said set of a plurality of magnets;

magnetic attraction of said first magnet of said set of a plurality of magnets with first end of an elongated edge of said elongated magnet, of said second magnet of said set of a plurality of magnets with said second end of an elongated edge of said elongated magnet, and of said first and second magnets of said set of a plurality of magnets;

(iii) Assigning the state of a changing solid line to:

magnetic repulsion of said first magnet of said set of a plurality of magnets with said first end of an elongated edge of said elongated magnet and of said second magnet of said set of a plurality of magnets with said second end of an elongated edge of said elongated magnet and magnetic attraction of said first and second magnets of said set of a plurality of magnets;

(iv) Assigning the state of a changing broken line to:

magnetic repulsion of said set of a plurality of magnets and magnetic attraction of said first magnet of said set of plurality of magnets with said first end of an elongated edge of said elongated magnet and said second magnet of said set of a plurality of magnets with said second end of an elongated edge of said elongated magnet.

4. The method of claim 1, comprising repeating steps (a)-(c) six times thereby to define a symbol consisting of six parallel lines.

5. The method of claim 1, comprising repeating steps (a)-(c) three times to form a symbol consisting of three parallel lines.

6. An apparatus for determining by chance the state for each of a plurality of lines having more than one possible state said plurality of lines together forming an I-Ching symbol, comprising:

a holder having a resting surface and a partition separating said resting surface into first and second compartments;

two relatively short magnets and an elongated magnet whereby placement of said relatively short magnets in said first compartment and placement of said elongated magnet in said second compartment in a proximate juxtaposed relationship induces magnetic interaction between said relatively short magnets with each other and between each relatively short magnet and said second magnet to provide a magnetic interaction between three adjacent pairs of magnetic poles wherein each magnet interacts with two other magnets, said partition preventing said magnets from being displaced from said compartments.

7. The apparatus of claim 6 wherein the holder is fabricated out of a non-magnetic material.

8. The apparatus of claim 6 wherein the resting surface of the holder is flat.

9. The apparatus of claim 6 wherein the holder has a peripheral wall located around the circumference of the resting surface to further retain said magnets in said compartments.

10. The apparatus of claim 9 wherein said peripheral wall and said partition limit movement of said elongated magnet within said second compartment whereby said elongated magnet cannot rotate more than 89 degrees and the elongated magnet serves as a constant unknown magnetic field on the relatively short magnets.

11. The apparatus of claim 9 wherein said second compartment of said holder has a retaining wall above the resting surface to retain said elongated magnet in said second compartment.

* * * * *